US006271505B1

(12) United States Patent
Henderson

(10) Patent No.: US 6,271,505 B1
(45) Date of Patent: Aug. 7, 2001

(54) FIELD CONVERSION ELECTRIC WATER HEATER

(75) Inventor: David L. Henderson, Millbrook, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 09/505,639

(22) Filed: Feb. 16, 2000

(51) Int. Cl.[7] ..... H05B 3/02

(52) U.S. Cl. ..... 219/483; 219/486; 219/488; 392/454

(58) Field of Search ..... 219/483, 482, 219/484, 486, 488; 392/454, 449, 498

(56) References Cited

U.S. PATENT DOCUMENTS

| | | | | |
|---|---|---|---|---|
| 4,547,689 | | 10/1985 | Tsuchimoto et al. | 310/71 |
| 4,549,159 | | 10/1985 | McGhee et al. | 337/301 |
| 4,742,210 | | 5/1988 | Tsuchiyama et al. | 219/541 |
| 4,781,610 | | 11/1988 | Mercer | 439/217 |
| 4,948,948 | * | 8/1990 | Lesage | 392/454 |
| 5,007,156 | | 4/1991 | Hurtgen | 29/596 |
| 5,168,546 | * | 12/1992 | Laperriere | 392/454 |
| 5,581,137 | | 12/1996 | Lundquist et al. | 310/68 R |
| 5,808,277 | * | 9/1998 | Dosani et al. | 392/454 |
| 6,137,955 | * | 10/2000 | Krell et al. | 392/454 |

OTHER PUBLICATIONS

Rheem Light Duty Electric Water Heater Use and Care Manual Sheets (Jun. 1998).

* cited by examiner

*Primary Examiner*—Teresa Walberg
*Assistant Examiner*—Thor Campbell
(74) *Attorney, Agent, or Firm*—Konneker & Smith, P.C.

(57) ABSTRACT

An electric water heater has upper and lower electric resistance type heating elements respectively controlled by a single pole, double throw upper thermostat and a single pole, single throw lower thermostat. The upper and lower thermostats are operatively interconnected by a wiring harness having outer wire end portions that may be connected in various orientations to the terminal block portion of an external junction box to provide the water heater with a variety of heating element operating modes without having to replace either of the thermostats or vary the wiring harness interconnections therebetween. The water heater may thus be advantageously manufactured in a single variant that may be easily and quickly modified in the field to selectively alter the heating element control mode of the water heater.

16 Claims, 2 Drawing Sheets

FIELD CONVERSION ELECTRIC WATER HEATER

BACKGROUND OF THE INVENTION

The present invention generally relates to electric heating apparatus and, in a preferred embodiment thereof, more particularly relates to a specially designed dual element electric water heater which is easily field convertible among various heating element control modes without the previous necessity of changing either of the heating element control thermostats or altering the wiring interconnections therebetween.

In a common construction thereof a vertically oriented dual element electric water heater has spaced apart upper and lower resistance type electric heating elements which horizontally extend into the interior of the water storage tank portion of the heater. The operation of these upper and lower heating elements is controlled by upper and lower electric thermostats which are respectively associated with the upper and lower heating elements.

Various modes of operating the upper and lower heating elements, with either single or three phase electric power supply to the water heater, are typically available. Representatively, these heating element operational modes include (1) single phase simultaneous element operation, in which the two heating elements are simultaneously cycled by their associated thermostats; (2) single phase simultaneous element operation with 4 wire outlet operation, (3) single phase non-simultaneous element operation, in which the two heating elements are independently cycled by their associated thermostats, (4) single phase non-simultaneous element operation with 4 wire outlet operation; (5) single phase non-simultaneous element operation with 3 wire outlet operation; (6) three phase simultaneous element operation; and (7) three phase non-simultaneous element operation. The two heating element-controlling thermostats are typically disposed in openings formed in the jacket insulation structure of the water heater that surrounds its storage tank portion. The electrical wiring that operatively interconnects the thermostats is, for the most part, disposed between the tank and the insulation structure.

In the past, in order to provide these seven representative element control modes seven separate embodiments or "variants" of the water heater needed to be built, with each water heater variant having different thermostat wiring configurations and/or combinations of thermostat types. The need to build separate variants to provide all of the representative types of heating element control listed above carries with it several problems, limitations and disadvantages.

For example, the construction of the water heater is made more complex since, in essence, it needs to be constructed in seven different ways—each having a different thermostat type combination and/or thermostat wiring interconnection configuration. Additionally, and quite importantly, once the water heater is constructed to provide a predetermined element: control mode, it is not practical or economical to alter this selected control mode. This is due to the fact that to alter the originally built-in element control mode, changes must be made to the thermostat wiring and/or the types of thermostats used must be altered. Because the thermostat interconnection wiring is disposed between the jacket insulation structure and the water heater storage tank portion such wiring is, as a practical matter, inaccessible for such conversion.

Accordingly, if a dual element water heater constructed in this conventional manner does not provide the desired heating element control mode, it has to be replaced with another manufactured variant of the water heater that has the desired heating element control mode incorporated therein during its original manufacture. In view of this it can be readily seen that a need exists for a dual element electric water heater which eliminates or at least substantially reduces the above-mentioned problems, limitations and disadvantages typically associated with conventionally constructed dual element electric water heaters. It is to this need that the present invention is directed.

SUMMARY OF THE INVENTION

In carrying out principles of the present invention, in accordance with a preferred embodiment thereof, a liquid heating apparatus having first and second spaced apart liquid heating elements is provided. The apparatus is representatively in the form of an electric water heater having vertically spaced apart upper and lower electric resistance type heating elements that horizontally extend into the interior of a water storage tank portion of the water heater. First and second electric thermostats are respectively and controllingly associated with the upper and lower heating elements, and wiring, representatively in the form of a wiring harness, is operatively connected to the first and second thermostats and has lead end portions variably connectable to a source of electrical power. The water heater also preferably includes a junction box having a terminal block portion with line side terminals to which electrical power supply leads may be variably connected, and water heater side terminals to which the aforementioned wiring harness lead end portions may be variably connected.

Preferably, the first electric thermostat, which controls the upper heating element, is of a single pole double throw configuration, and the second electric thermostat, which controls the lower heating element, is of a single pole single throw configuration. The wiring harness is connected to the first and second thermostats in a manner such that, without replacing either of the first and second thermostats and/or altering the wiring connections to either thermostat, a plurality of heating element control modes may be provided simply by changing the wiring connections to the terminal block.

Representatively, these element control modes include (1) a single phase simultaneous dual element control mode, (2) a single phase simultaneous dual element control mode with four wire outlet operation, (3) a single phase non-simultaneous dual element control mode, (4) a single phase non-simultaneous dual element control mode with four wire outlet operation, (5) a single phase non-simultaneous dual element control mode with three wire outlet operation, (6) a three phase simultaneous dual element control mode, and (7) a three phase non-simultaneous dual element control mode.

In an illustrated preferred embodiment of the electric water heater, the first electric thermostat has an ECO portion with first, second, third and fourth power supply terminals, and a switch portion with a switch power terminal and first and second switch contacts. The second electric thermostat has an ECO portion with first, second, third and fourth power supply terminals, a switch power terminal and a switch contact.

Additionally, the wiring harness includes (1) a first wire interconnected between the first power supply terminal of said first thermostat ECO portion and the switch power terminal of the first thermostat switch portion, (2) a second wire interconnected between the first switch contact of the first thermostat switch portion and the upper heating element, (3) a third wire interconnected between the fourth power supply terminal of the first thermostat ECO portion and the upper heating element, (4) a fourth wire interconnected between the first power supply terminal of the second thermostat ECO portion and the switch power terminal of the second thermostat, (5) a fifth wire interconnected between the switch contact of the second thermostat switch portion and the lower heating element, (6) a sixth wire interconnected between the fourth power supply terminal of the second thermostat ECO portion and said lower heating element, and (7) a series Of electrical leads each having a first end portion operatively connected to one of the first and second thermostats, and a second end variably connectable to the water heater side of the terminal block.

The series of wiring harness leads variably connectable to the water heater side of the terminal block preferably include (1) a first lead connected at one end to the first power supply terminal of the second thermostat ECO portion and variably connectable at the other end to the water heater side of the terminal block, (2) a second lead connected at one end to the first power supply terminal of the first thermostat ECO portion and variably connectable at the other end to the water heater side of the terminal block, (3) a third lead connected at one end to the second power supply terminal of the first thermostat ECO portion and variably connectable at the other end to the water heater side of the terminal block, (4) a fourth lead connected at one end to the second switch contact of the first thermostat switch portion and variably connectable at the other end to the water heater side of the terminal block, and (5) a fifth lead connected at one end to the second power supply terminal of the second thermostat ECO portion and variably connectable at the other end to the water heater side of the terminal block.

In a preferred embodiment of the dual element electric water heater the water heater has an external well area in which the terminal block ends of the wiring harness leads may be disposed prior to their operative connection to the terminal block, and the junction box is removably connectable to the water heater and may be shipped loose therewith for subsequent mounting thereon and operative connection to external power supply leads and the terminal block ends of the wiring harness leads.

While the liquid heating apparatus of the present invention is representatively an electric water heater, it could alternatively be a variety of other types of liquid heating apparatus. Additionally, while the outer ends of the aforementioned wiring harness leads are representatively connectable in selectively variable manners to a terminal block portion of a junction box, it will be readily appreciated by those of skill in this particular art that they could alternatively be variably connected to an electrical power source in a variety of other manners if desired.

DETAILED DESCRIPTION

Figure 1:
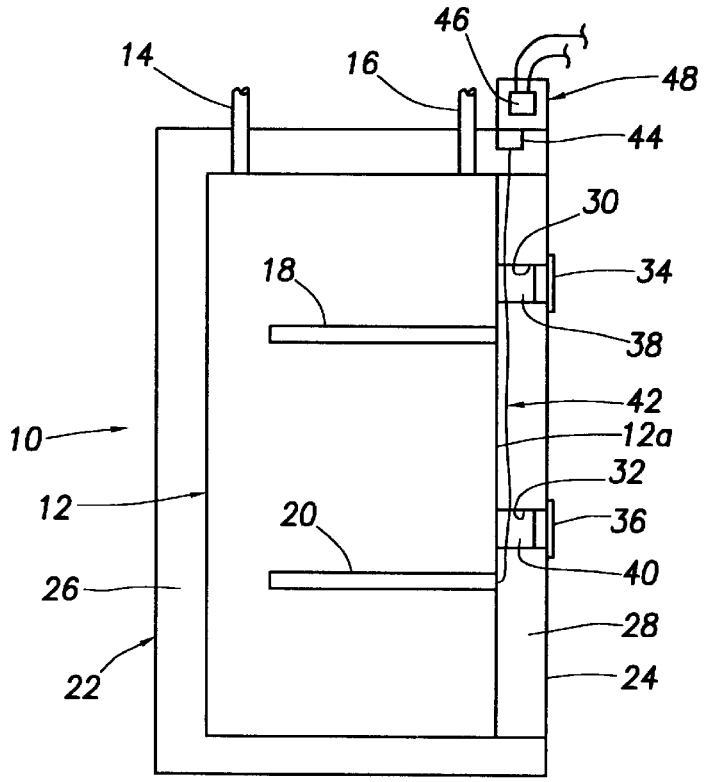
FIG. 1 is a highly schematic cross-sectional view through a field conversion dual element electric water heater embodying principles of the present invention.

Schematically illustrated in FIG. 1 is a dual element electric water heater 10 embodying principles of the present invention. Water heater 10 includes a vertically oriented cylindrical metal water storage tank 12 which has, at its top end, suitable water inlet and outlet piping connections 14 and 16. Vertically spaced apart elongated upper and lower electric resistance type water heating elements 18 and 20 longitudinally extend horizontally into the interior of the tank 12 from a vertical sidewall portion thereof. The tank 12 is surrounded by an insulation jacket structure 22 including an outer metal skin portion 24 and a foamed-in insulation material 26 interposed between the metal skin portion 24 and the tank 12.

Extending along a vertical side portion 12*a* of the tank through which the upper and lower heating elements 18,20 inwardly extend is an insulating bag structure 28 which is filled with the insulating material 26 and has a vertically spaced pair of peripherally sealed access openings 30,32 extending therethrough and respectively positioned somewhat above the outer ends of the upper and lower heating elements 18,20. Bag openings 30,32 are respectively aligned with sidewall access openings formed in the jacket metal skin portion 24 and covered by removable access plates 34 and 36. Upper and lower electric thermostats 38,40 are respectively received in the bag access openings 30,32 and may be accessed by removing the plates 34 and 36.

The upper and lower thermostats 38 and 40 are respectively and controllingly coupled to the upper and lower heating elements 18,20 and are electrically interconnected to one another by a subsequently described wiring harness 42 which is disposed between the insulation bag 28 and a vertical sidewall portion of the tank 12. During shipment of the water heater 10, upper end portions of various individual wires which make up the harness 42 are placed in a top end well area 44 in the water heater 10 for subsequent operative connection to a terminal block portion 46 of a junction box 48. Representatively, the junction box 48 is shipped loose with the water heater and is subsequently attached to a top end portion thereof as schematically depicted in FIG. 1.

Figure 2:
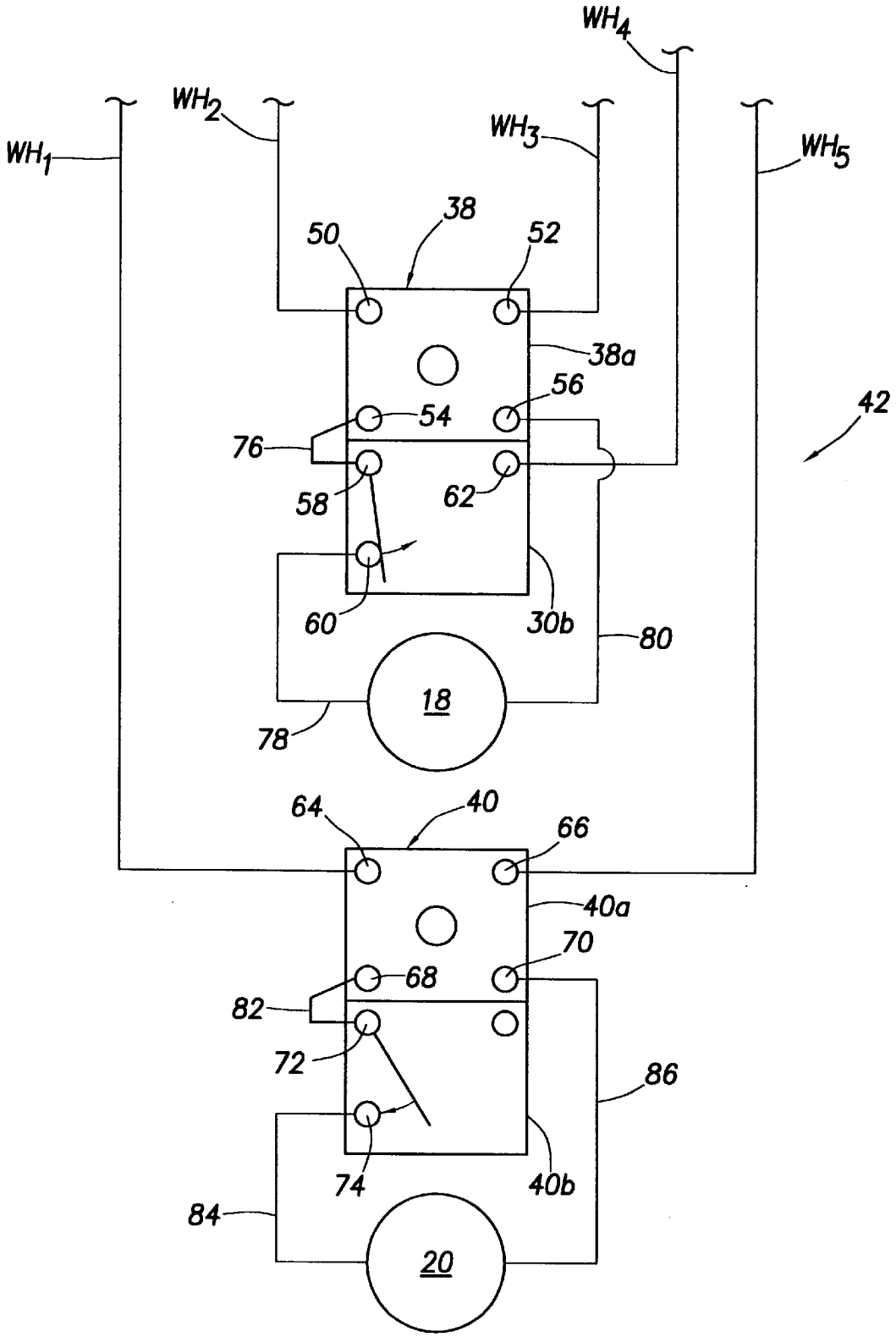
FIG. 2 is a schematic wiring diagram of a thermostat/heating element portion of the water heater.

Turning now to FIG. 2, in the illustrated preferred embodiment of the dual element electric water heater 10, the upper thermostat 38 is of a single pole double throw configuration and has an ECO (energy cut-off) high limit control portion 38*a* operatively associated with a switch portion 38*b*, and the lower thermostat 40 is of a single pole single throw configuration and has an ECO high limit control portion 40*a* operatively associated with a switch portion 40*b*.

The upper thermostat ECO portion 38*a* has power supply terminals 50,52,54,56, and the upper thermostat switch portion 38*b* has a switch power terminal 58 and switch contacts 60 and 62. The lower thermostat ECO portion 40*a* has power supply terminals 64,66,68,70, and the lower thermostat switch portion 40*b* has a switch power terminal 72 and a switch contact 74.

Wiring harness 42 includes a wire 76 interconnected between the power supply terminal 54 and the switch power terminal 58; a wire 78 interconnected between the switch contact 60 and the upper heating element 18; a wire 80 interconnected between the power supply terminal 56 and the upper heating element 18; a wire 82 interconnected between the power supply terminal 68 and the switch power terminal 72; a wire 84 interconnected between the switch contact 74 and the lower heating element 20; and a wire 86 interconnected between the power supply terminal 70 and the lower heating element 20.

The wiring harness 42 also includes five water heater power connection leads $WH_1$,–$WH_5$ which are connectable in various subsequently described, selectively variable manners to the terminal block portion 46 of the junction box 48 to provide the upper and lower heating elements with a variety of control modes without the necessity of removing and replacing either of the thermostats 38,40 and/or altering any of the wiring that interconnects the thermostats 38,40. The power connection leads $WH_1$–$WH_5$ extend upwardly from the thermostats 38,40 behind the insulation bag 28 (see FIG. 1), with upper end portions of the leads $WH_1$–$WH_5$ being received in the well area 44 prior to connection of such upper lead end portions to the terminal block 46 as subsequently described herein.

As schematically depicted in FIG. 2, the lower end of lead $WH_1$ is connected to the lower thermostat power supply terminal 64; the lower end of lead $WH_2$ is connected to the upper thermostat power supply terminal 50; the lower end of lead $WH_3$ is connected to the upper thermostat power supply terminal 52; the lower end of lead $WH_4$ is connected to the upper thermostat switch contact 62; and the lower end of lead $WH_2$ is connected to the lower thermostat power supply terminal 66.

Figure 3:
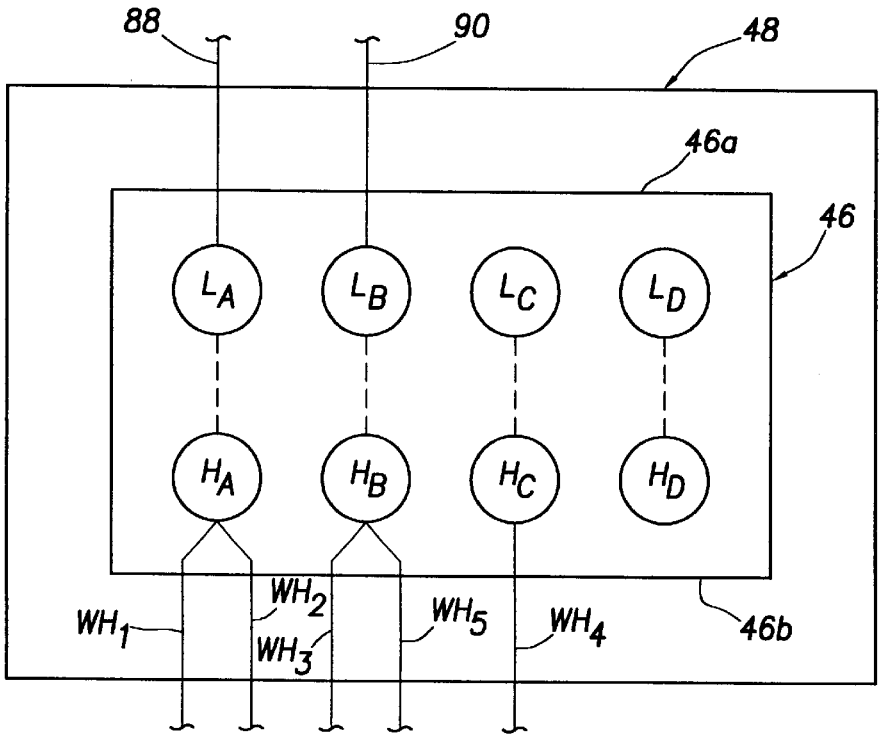
FIG. 3 is a schematic diagram of a junction box/terminal block structure operatively associated with the heating element control thermostats of the water heater.

Turning now to FIG. 3, the terminal block portion 46 of the junction box 48 has a line side 46*a* with terminals $L_A$–$L_D$, and a water heater side 46*b* with terminals $H_A$–$H_D$ electrically coupled to the line side terminals $L_A$–$L_D$as indicated by the dashed lines. With the junction box 48 operatively mounted on the top end of the water heater 10 as schematically shown in FIG. 1, the control mode of the water heater's upper and lower heating elements 18,20 may be selectively varied simply by reconfiguring various wiring connections to the terminal block 46 as will now be described.

Representatively, there are seven different dual heating element operational control modes available for the water heater 10 simply by altering the wiring connections to the terminal block 46, and without changing the wiring interconnection between the thermostats 38,40 and/or replacing either thermostat with another type of thermostat. These seven heating element operational control modes, and the terminal block wiring configurations that yield them, are as follows:

Single Phase Simultaneous Dual Element Control Mode

As schematically depicted in FIG. 3, to provide the water heater 10 with a single phase, simultaneous control of its upper and lower electric resistance type upper and lower heating elements 18 and 20, single phase power supply lines 88,90 are respectively connected to the terminal block line side terminals $L_A$ and $L_B$. On the water heater side 46*b* of the terminal block 46 wiring harness leads $WH_1$ and $WH_2$ are connected to the terminal $H_A$, wiring harness leads $WH_3$ and $WH_5$ are connected to the terminal $H_B$, and the wiring harness lead $WH_4$ is connected to the terminal $H_C$.

Single Phase Simultaneous Dual Element Control Mode With 4 Wire Outlet Operation To provide this dual element operational control mode, the two single phase power supply leads are connected to terminals $L_A$ and $L_B$ on the line side 46*a* of the terminal block 46. On the water heater side 46*b* of the terminal block 46, wiring harness lead $WH_2$ is connected to terminal $H_A$, wiring harness lead $WH_3$ is connected to terminal $H_B$, and wiring harness lead $WH_4$ is connected to terminal $H_C$. Wiring harness leads $WH_1$ and $WH_5$ are connected to an off peak meter or timer.

Single Phase Non-Simultaneous Dual Element Control Mode

To provide this dual element operational control mode, the two single phase power supply leads are connected to terminals $L_A$ and $L_B$ on the line side 46*a* of the terminal block. On the water heater side 46*b* of the terminal block 46 wiring harness leads $WH_1$ and $WH_3$ are connected to terminal $H_B$, wiring harness lead $WH_2$ is connected to terminal $H_A$, and wiring harness leads $WH_4$ and $WH_5$ are connected to terminal $H_C$.

Single Phase Non-Simultaneous Dual Element Control Mode With 4 Wire Outlet operation To provide this dual element operational control mode, the two single phase power supply leads are connected to terminals $L_A$ and $L_B$ on the line side 46*a* of the terminal block. On the water heater side 46*b* of the terminal block 46 wiring harness leads $WH_1$ and $WH_3$ are connected to terminal $H_B$, wiring harness lead $WH_2$ is connected to terminal $H_A$, and wiring harness leads $WH_4$ and $WH_5$ are connected to terminal $H_C$. Additionally, if off peak metering is desired, an off peak meter or timer is connected to terminals $L_C$ and $L_D$ on the line side 46*a* of the terminal block, wiring harness lead $WH_4$ is connected to terminal $H_C$, and wiring harness lead $WH_5$ is connected to terminal $H_D$.

Single Phase Non-Simultaneous Dual Element Control Mode With 3 Wire Outlet Operation To provide this dual element operational control mode, the two single phase power supply leads are connected to terminals $L_A$ and $L_B$ on the line side 46*a* of the terminal block. On the water heater side 46*b* of the terminal block 46 wiring harness lead $WH_2$ is connected to terminal $H_A$, wiring harness lead $WH_3$ is connected to terminal $H_B$, and wiring harness leads $WH_4$ and $WH_5$ are connected to terminal $H_C$. If off peak metering is desired, wiring harness lead $WH_1$ is connected to terminal $H_D$ and an off peak meter is connected to terminal $L_D$.

Three Phase Simultaneous Dual Element Control Mode

To provide this dual element operational control mode, three phase power supply leads are connected to the terminal block line side terminals $L_A$, $L_B$ and $L_D$. On the water heater side 46*b* of the terminal block 46 wiring harness leads $WH_1$ and $WH_2$ are connected to terminal $H_A$, wiring harness lead $WH_3$ is connected to terminal $H_B$, wiring harness lead $WH_4$ is connected to terminal $H_C$, and wiring harness lead $WH_5$ is connected to terminal $H_D$.

Three Phase Non-Simultaneous Dual Element Control Mode

To provide this dual element operational control mode, three phase power supply leads are connected to the terminal block line side terminals $L_A$, $L_B$ and $L_C$. On the water heater side 46*b* of the terminal block 46 wiring harness lead $WH_1$ is connected to terminal $H_A$, wiring harness lead $WH_2$ is connected to terminal $H_B$, wiring harness lead $WH_3$ is connected to terminal $H_C$, and wiring harness leads $WH_4$ and $WH_5$ are connected to terminal $H_D$.

As can readily be seen from the foregoing, the water heater 10 may uniquely be field-converted selectively among its seven representative dual heating element operational control modes simply by appropriately altering the electrical connections to the terminal block 46. In contrast to conventionally constructed dual element electric water heaters, there is simply no need to either (1) replace either of the upper and lower thermostats 38,40 with another type of thermostat, and/or (2) change the wiring connections to the two thermostats. This advantageously makes the representatively listed seven dual heating element operational control modes available with the single illustrated variant of the dual element electric water heater 10. While the present invention has been illustratively incorporated in an electric water heater it will be readily appreciated that principles of the invention could also be incorporated in dual element liquid heating devices of other types if desired. It will additionally be appreciated that while the outer ends of the wiring harness leads $WH_1$–$WH_5$ are representatively connectable in selectively variable manners to a terminal block portion of a junction box, they could alternatively be variably connected to an external electrical power source in a variety of other manners if desired.

The foregoing detailed description is to be clearly understood as being given by way of illustration and example, the spirit and scope of the present invention being limited solely by the appended claims.

What is claimed is:

1. Liquid heating apparatus comprising:

a tank adapted to hold a quantity of liquid to be heated;

first and second spaced apart electric heating elements extending into the interior of said tank and being operable to heat liquid therein;

first and second electric thermostats respectively and controllingly associated with said first and second electric heating elements; and wiring operatively connected to said first and second thermostats and having portions variably connectable to a source of electrical power, said wiring being connected to said first and second thermostats in a manner such that, without replacing either of said first and second thermostats or altering the wiring connections to either of said first and second thermostats, said wiring may be variably connected to a source of electrical power to provide said liquid heating apparatus with a plurality of heating element control modes.

2. The liquid heating apparatus of claim 1 wherein said liquid heating apparatus is an electric water heater.

3. The liquid heating apparatus of claim 1 wherein:

said first and second electric heating elements are vertically spaced apart electric resistance type heating elements with said first heating element being disposed higher than said second heating element.

4. The liquid heating apparatus of claim 3 wherein:

said first electric thermostat is a single pole double throw thermostat, and said second electric thermostat is a single pole single throw thermostat.

5. The liquid heating apparatus of claim 1 wherein:

said liquid heating apparatus further comprises a junction box having a terminal block with line side terminals to which electrical power supply leads are variably connectable, and a heating apparatus side with terminals, and said wiring includes heating apparatus leads having first ends connected in a fixed relationship to said first and second electric thermostats, and second ends variably connectable to said heating apparatus terminals on said terminal block.

6. The liquid heating apparatus of claim 5 wherein:

said liquid heating apparatus further comprises an exterior insulating jacket structure with a recessed well area adapted to receive said second ends Of said heating apparatus leads prior to the connection thereof to said heating apparatus terminals on said terminal block.

7. An electric water heater comprising:

a tank adapted to hold a quantity of water to be heated;

an upper electric resistance type heating element horizontally extending into the interior of said tank;

a lower electric resistance type heating element horizontally extending into the interior of said tank;

a first electric thermostat controllingly associated with said upper heating element, said first electric thermostat being a single pole double throw thermostat;

a second electric thermostat controllingly associated with said lower heating element, said second electric thermostat being a single pole single throw thermostat; and a wiring harness operatively connected to said first and second electric thermostats and having lead portions variably connectable to a source of electrical power, said wiring harness being connected to said first and second thermostats in a manner such that, without replacing either of said first and second thermostats and/or altering the wiring connections to either of said first and second thermostats, said wiring harness may be variably connected to a source of electrical power to provide said electric water heater with a plurality of heating element control modes.

8. The electric water heater of claim 7 wherein:

said heating element control modes include simultaneous control of said upper and lower heating elements and non-simultaneous control of said upper and lower heating elements.

9. An electric water heater comprising:

a tank adapted to hold a quantity of water to be heated;

an upper electric resistance type heating element horizontally extending into the interior of said tank;

a lower electric resistance type heating element horizontally extending into the interior of said tank;

a first electric thermostat controllingly associated with said upper heating element, said first electric thermostat being a single pole double throw thermostat;

a second electric thermostat controllingly associated with said lower heating element, said second electric thermostat being a single pole single throw thermostat; and a wiring harness operatively connected to said first and second electric thermostats and having lead portions variably connectable to a source of electrical power, said wiring harness being connected to said first and second thermostats in a manner such that, without replacing either of said first and second thermostats and/or altering the wiring connections to either of said first and second thermostats, said wiring harness may be variably connected to a source of electrical power to provide said electric water heater with a plurality of heating element control modes, said heating element control modes including:

(1) a single phase simultaneous dual element control mode, (2) a single phase simultaneous dual element control mode with four wire outlet operation, (3) a single phase non-simultaneous dual element control mode, (4) a single phase non-simultaneous dual element control mode with four wire outlet operation, (5) a single phase non-simultaneous dual element control mode with three wire outlet operation, (6) a three phase simultaneous dual element control mode, and (7) a three phase non-simultaneous dual element control mode.

10. An electric water heater comprising:

a tank adapted to hold a quantity of water to be heated;

an upper electric resistance type heating element horizontally extending into the interior of said tank;

a lower electric resistance type heating element horizontally extending into the interior of said tank;

a first electric thermostat controllingly associated with said upper heating element, said first electric thermostat being a single pole double throw thermostat;

a second electric thermostat controllingly associated with said lower heating element, said second electric thermostat being a single pole single throw thermostat; and a wiring harness operatively connected to said first and second electric thermostats and having lead portions variably connectable to a source of electrical power, said wiring harness being connected to said first and second thermostats in a manner such that, without replacing either of said first and second thermostats and/or altering the wiring connections to either of said first and second thermostats, said wiring harness may be variably connected to a source of electrical power to provide said electric water heater with a plurality of heating element control modes, said first electric thermostat having an ECO portion with first, second, third and fourth power supply terminals, and a switch portion with a switch power terminal and first and second switch contacts, said second electric thermostat having an ECO portion with first, second, third and fourth power supply terminals, a switch power terminal and a switch contact, and said wiring harness including:

(1) a first wire interconnected between said third power supply terminal of said first thermostat ECO portion and said switch power terminal of said first thermostat switch portion, (2) a second wire interconnected between said first switch contact of said first thermostat switch portion and said upper heating element, (3) a third wire interconnected between said fourth power supply terminal of said first thermostat ECO portion and said upper heating element, (4) a fourth wire interconnected between said third power supply terminal of said second thermostat ECO portion and said switch power terminal of said second thermostat, (5) a fifth wire interconnected between said switch contact of said second thermostat switch portion and said lower heating element, (6) a sixth wire interconnected between said fourth power supply terminal of said second thermostat ECO portion and said lower heating element, and (7) a series of electrical leads each having a first end portion operatively connected to one of said first and second thermostats, and a second end connectable to said source of electrical power.

11. The electric water heater of claim 10 wherein said series of electrical leads include:

(1) a first lead connected at one end to said first power supply terminal of said second thermostat ECO portion and variably connectable at the other end to said source of electrical power, (2) a second lead connected at one end to said first power supply terminal of said first thermostat ECO portion and variably connectable at the other end to said source of electrical power, (3) a third lead connected at one end to said second power supply terminal of said first thermostat ECO portion and variably connectable at the other end to said source of electrical power, (4) a fourth lead connected at one end to said second switch contact of said first thermostat switch portion and variably connectable at the other end to said source of electrical power, and (5) a fifth lead connected at one end to said second power supply terminal of said second thermostat ECO portion and variably connectable at the other end to said source of electrical power.

12. The electric water heater of claim 11 wherein:

said electric water heater further comprises a terminal block having line side terminals to which external power supply leads may be variably connected, and line side terminals to which said other ends of said series of wiring harness leads may be variably connected.

13. The electric water heater of claim 12 wherein:

said terminal block is incorporated in a junction box removably securable to said electric water heater.

14. The electric water heater of claim 13 wherein:

said electric water heater has an external well area in which said other ends of said series of wiring harness leads may be disposed prior to their operative connection to said terminal block.

15. Liquid heating apparatus comprising:

a tank adapted to hold a quantity of liquid to be heated;

first and second spaced apart electric heating elements extending into the interior of said tank and being operable to heat liquid therein;

first and second electric thermostats respectively and controllingly associated with said first and second electric heating elements; and wiring operatively connected to said first and second thermostats and having portions variably connectable to a source of electrical power, said wiring being connected to said first and second thermostats in a manner such that, without replacing either of said first and second thermostats or altering the wiring connections to either of said first and second thermostats, said wiring may be variably connected to a source of electrical power to provide said liquid heating apparatus with a plurality of heating element control modes including (1) thermostatically controlled simultaneous energization of said first and second heating elements and (2) thermostatically controlled sequential energization of said first and second heating elements.

16. An electric water heater comprising:

a tank adapted to hold a quantity of water to be heated;

an upper electric resistance type heating element horizontally extending into the interior of said tank;

a lower electric resistance type heating element horizontally extending into the interior of said tank;

a first electric thermostat controllingly associated with said upper heating element, said first electric thermostat being a single pole double throw thermostat;

a second electric thermostat controllrngiv associated with said lower heating element, said second electric thermostat being a single pole single throw thermostat; and a wiring harness operatively connected to said first and second electric thermostats and having lead portions variably connectable to a source of electrical power, said wiring harness being connected to said first and second thermostats in a manner such that, without replacing either of said first and second thermostats and/or altering the wiring connections to either of said first and second thermostats, said wiring harness may be variably connected to a source of electrical power to provide said electric water heater with a plurality of heating element control modes including (1) thermostatically controlled simultaneous energization of said upper and lower heating elements and (2) thermostatically controlled sequential energization of said upper and lower heating elements.

* * * * *